US012729689B2

(12) United States Patent
Liu et al.

(10) Patent No.: US 12,729,689 B2
(45) Date of Patent: Sep. 8, 2026

(54) COMPRESSOR

(71) Applicant: Hitachi-Johnson Controls Air Conditioning, Inc., Tokyo (JP)

(72) Inventors: Nina Liu, Tokyo (JP); Damon Wang, Tokyo (JP); Jason Peng, Tokyo (JP); Jiehao Hu, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 19/263,730

(22) Filed: Jul. 9, 2025

(65) Prior Publication Data

US 2026/0117774 A1 Apr. 30, 2026

(30) Foreign Application Priority Data

Oct. 29, 2024 (CN) ..... 202411524317.5

(51) Int. Cl.
*F04C 29/12* (2006.01)
*F04C 18/02* (2006.01)
*F04C 29/06* (2006.01)

(52) U.S. Cl.
CPC ..... *F04C 29/124* (2013.01); *F04C 18/0215* (2013.01); *F04C 29/065* (2013.01); *F04C 2240/30* (2013.01)

(58) Field of Classification Search
CPC .. F04C 29/124; F04C 29/126; F04C 18/0215; F04C 29/065; F04C 2240/30
See application file for complete search history.

(56) References Cited

FOREIGN PATENT DOCUMENTS

CN 104343693 B * 2/2017 ..... F04C 29/126
CN 111980918 A * 11/2020 ..... F04C 18/0223

OTHER PUBLICATIONS

English Translation CN-104343693-B (Year: 2017).*
English Translation CN-111980918-A (Year: 2020).*

* cited by examiner

*Primary Examiner* — Shafiq Mian
(74) *Attorney, Agent, or Firm* — MATTINGLY & MALUR, PC

(57) ABSTRACT

A compressor with fixed and orbiting scrolls and the fixed scroll is provided with an exhaust hole for the compression chamber. The check valve comprises a valve seat, a valve plate, and a limiting plate. The valve seat comprises a base and at least two bosses. The base is provided with a first through-hole, the at least two bosses are arranged at intervals around the first through-hole, and gas flow passages are formed between adjacent bosses and in communication with the first cavity. The limiting plate is connected to an end of each of the bosses and the exhaust hole has a smaller cross-sectional area than the first through-hole. The at least two bosses encircle a sliding channel therebetween, the valve plate is slidably connected to the sliding channel and along which the valve plate is slidable between the limiting plate and the base.

10 Claims, 7 Drawing Sheets

COMPRESSOR

CROSS-REFERENCE TO RELATED APPLICATION

The present application claims priority from Chinese Patent Application CN 202411524317.5, filed on Oct. 29, 2024, the content of which is hereby incorporated by reference into this application.

TECHNICAL FIELD

The present application relates to the field of gas compression equipment, and in particular, to a compressor.

BACKGROUND

In related art, a compressor is a fluid machine that compresses low-pressure gas into high-pressure gas, and is an important component of a refrigeration system. The compressor mainly sucks low-pressure gas from a low-pressure chamber into a compression chamber and discharges the compressed high-pressure gas in the compression chamber to a high-pressure chamber, in order to achieve the conversion of the low-pressure gas into the high-pressure gas. However, when the compressor is shut down, since the gas pressure in the high-pressure chamber is higher than that in the compression chamber, the gas in the high-pressure chamber is prone to leak into the compression chamber, and the high-pressure gas leaked into the compression chamber will drive the compressor to rotate in an opposite direction, resulting in decrease in the gas pressure in the high-pressure chamber and the generation of noise and other phenomena. Based on this, it is usually necessary to provide a check valve in the fixed scroll of the compressor to prevent backflow of the high-pressure gas. In the related art, when installing a check valve in a compressor, it is usually necessary to place a valve plate of the check valve at an exhaust port of a fixed scroll, and then fixedly connect other components of the check valve to the fixed scroll. In this process, since the position of the valve plate is not fixed, it may be offset during the installation of the check valve, and when this happens, it is usually necessary to reinstall the check valve, resulting in a problem that the installation process of the check valve in the existing compressor is relatively complicated.

SUMMARY

Embodiments of the present application provide a compressor to solve the problem that the installation process of the check valve in the existing compressor is relatively complicated.

To solve the above technical problem, the present application is implemented as follows.

In a first aspect, an embodiment of the present application provides a compressor comprises a housing, a fixed scroll, an orbiting scroll and a check valve, the fixed scroll and the orbiting scroll are respectively disposed in the housing, cooperatively connected to each other and encircle a compression chamber therebetween, the housing comprises a first cavity which is located on a side of the fixed scroll facing away from the orbiting scroll, and the fixed scroll is provided with an exhaust hole for the compression chamber;

the check valve comprises a valve seat, a valve plate and a limiting plate, wherein the valve seat is arranged on a side of the fixed scroll facing away from the orbiting scroll, and comprises a base and at least two bosses protruding from an end face of an end of the base facing away from the fixed scroll, wherein the base is provided with a first through-hole which is opposite to the exhaust hole, the at least two bosses are arranged at intervals around the first through-hole, and gas flow passages are formed between adjacent bosses and in communication with the first cavity, wherein the limiting plate is located on a side of the bosses facing away from the base and is fixedly connected to an end of each of the bosses which is away from the base, and the exhaust hole has a smaller cross-sectional area than the first through-hole;

the at least two bosses encircle a sliding channel therebetween, the valve plate is slidably connected to the sliding channel and along which the valve plate is slidable between the limiting plate and the base, wherein the first through-hole is opened and the first cavity is communicated with the compression chamber when the valve plate slides to abut against the limiting plate;

the valve plate closes the first through-hole and the first cavity is not communicated with the compression chamber when the valve plate slides to abut against the base.

In the embodiment of the present application, the check valve includes a valve seat, and at least two bosses of the valve seat encircle a sliding channel therebetween. In this way, it is possible to first place the valve plate in the sliding channel and then install the check valve in the process of installing the check valve in the compressor. Due to the limiting effect of the valve seat on the valve plate, the position of the valve plate will not be offset during the installation of the check valve, which is beneficial for simplifying the installation process of the check valve. In addition, the cross-sectional area of the exhaust hole is smaller than that of the first through-hole, which is beneficial for reducing a throttling loss in the check valve of the compressed gas discharged from the exhaust hole into the check valve.

BRIEF DESCRIPTION OF THE DRAWINGS

In order to clearly illustrate technical solutions of the embodiments of the present application, the drawings required for the description of the embodiments of the present application will be briefly described below. Obviously, the described drawings relate to only some embodiments of the present application, and those having ordinary skills in the art can obtain other drawings based on these drawings without exercising any inventive work.

DETAILED DESCRIPTION

Figure 1:
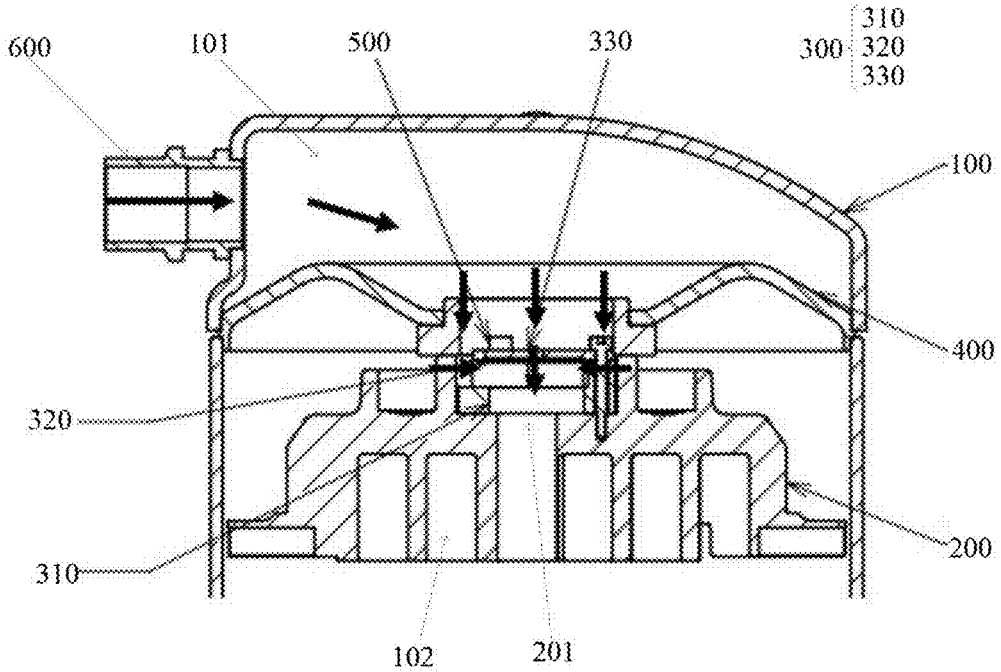
FIG. 1 is a schematic cross-sectional view of an upper half of a compressor in an embodiment of the present application.

Hereinafter, technical solutions in the embodiments of the present application will be described clearly and completely in conjunction with the drawings in the embodiments of the present application. Apparently, the described embodiments are a part, but not all, of the embodiments of the present application. All other embodiments, which are obtained by those having ordinary skills in the art based on the embodiments in the present application without exercising any inventive work, fall within the scope of protection of the present application.

Referring to FIGS. 1 to 11, an embodiment of the present application provides a compressor, which includes a housing 100, a fixed scroll 200, an orbiting scroll and a check valve 300. The fixed scroll 200 and the orbiting scroll are each disposed in the housing 100, are cooperatively connected to each other, and encircle a compression chamber 102 therebetween. The housing 100 includes a first cavity 101 which is located on a side of the fixed scroll 200 facing away from the orbiting scroll, and the fixed scroll 200 is provided with an exhaust hole 201 for the compression chamber 102.

The check valve 300 includes a valve seat 310, a valve plate 320, and a limiting plate 330. The valve seat 310 is disposed on the side of the fixed scroll 200 facing away from the orbiting scroll. The valve seat 310 includes a base 311 and at least two bosses 312 protruding from an end face of an end of the base 311 facing away from the fixed scroll 200. The base 311 is provided with a first through-hole 313, which is opposite to the exhaust hole 201 and around which the at least two bosses 312 are arranged at intervals, with gas flow passages 314 being formed between adjacent bosses 312 and in communication with the first cavity 101. The limiting plate 330 is located on a side of the bosses 312 facing away from the base 311, and is fixedly connected to an end of each of the bosses 312 away from the base 311. A cross-sectional area of the exhaust hole 201 is smaller than that of the first through-hole 313.

The at least two bosses 312 encircle a sliding channel 316 therebetween, to which the valve plate 320 is slidably connected, and along which the valve plate 320 can slide between the limiting plate 330 and the base 311. When the valve plate 320 slides to abut against the limiting plate 330, the first through-hole 313 is opened and the first cavity 101 is communicated with the compression chamber 102.

When the valve plate 320 slides to abut against the base 311, the valve plate 320 closes the first through-hole 313 and the first cavity 101 is not communicated with the compression chamber 102.

Figure 2:
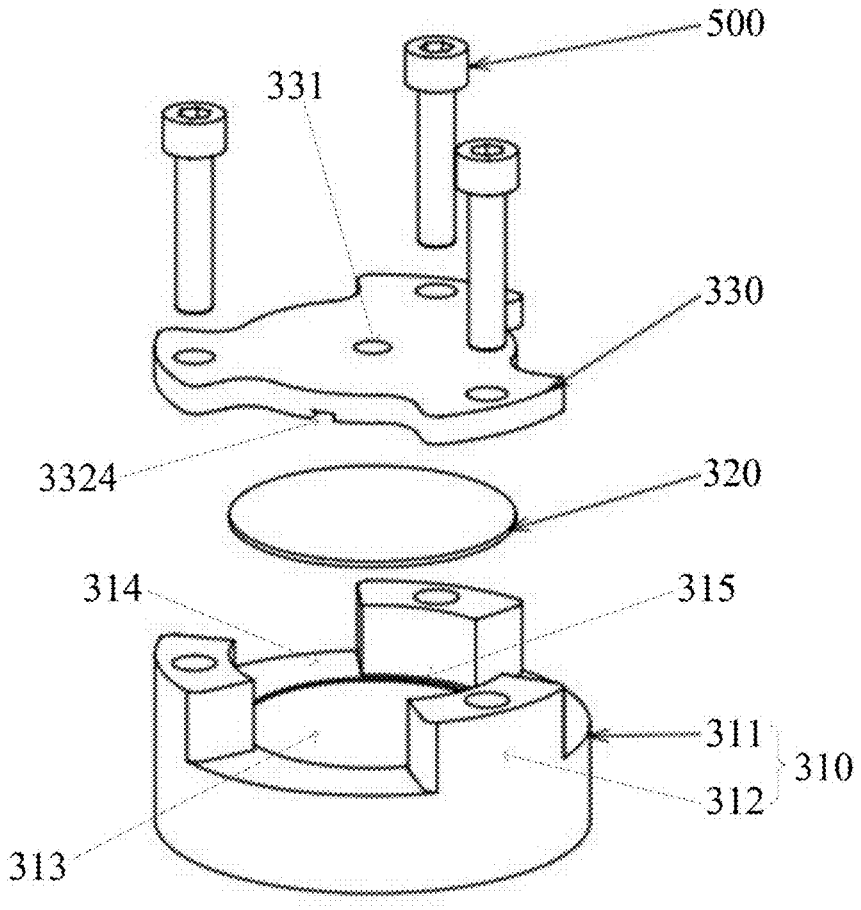
FIG. 2 is an exploded view of a structure of a check valve in an embodiment of the present application.

Referring to FIG. 2, in some embodiments of the present application, the base 311 may be cylindrical.

Figure 10:
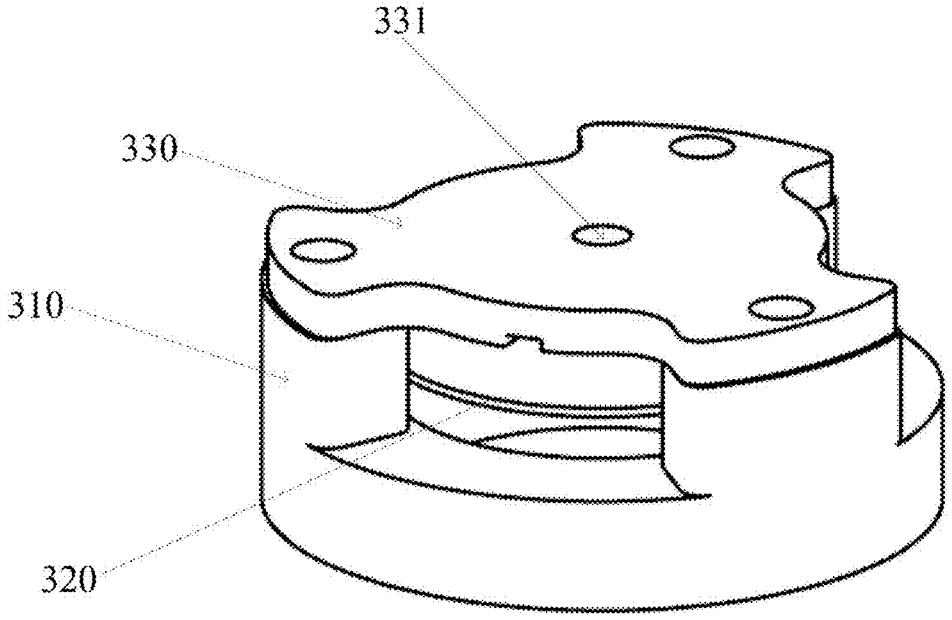
FIG. 10 is a first schematic structural diagram of a check valve in an embodiment of the present application.
Figure 11:
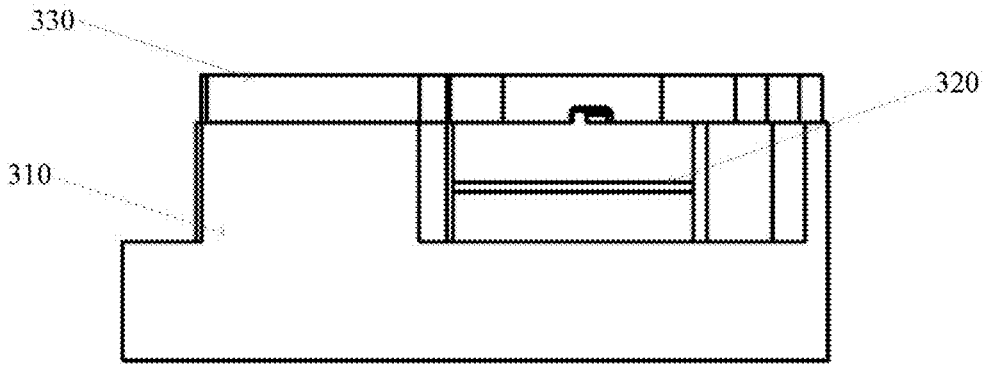
FIG. 11 is a second schematic structural diagram of a check valve in an embodiment of the present application.

Referring to FIGS. 10 and 11, the cross-sectional shape of the valve plate 320 may be the same as that of the sliding channel 316, and a side wall of the valve plate 320 can abut against an inner wall of the sliding channel 316, so that the at least two bosses 312 can limit radial movement of the valve plate. The cross-sectional shape of the valve plate 320 may be set as required, and for example, it may be circular, polygonal, or the like.

A projection of the exhaust hole 201 on an end face of an end of the base 311 facing the exhaust hole 201 can be located within the first through-hole 313, that is, the exhaust hole 201 is completely opposite to the first through-hole 313, which is beneficial for reducing a throttling loss of the compressed gas in the check valve 300. The throttling loss of the compressed gas in the check valve 300 refers to a capacity loss caused by the pressure drop of the compressed gas due to the throttling effect of the check valve 300 on the compressed gas when it flows through the check valve 300.

It should be understood that the base 311 can limit the valve plate 320 from sliding further toward the side of the base 311, and the limiting plate 330 can limit the valve plate 320 from sliding further toward the side of the limiting plate 330, that is, a sliding range of the valve plate 320 is limited between the limiting plate 330 and the base 311.

The cross-sectional area of the exhaust hole 201 is the orifice area of the exhaust hole 201, and correspondingly, the cross-sectional area of the first through-hole 313 is the orifice area of the first through-hole 313.

The compressor described above may be a scroll compressor, and may be specifically used as a compressor in a heat pump system of an air conditioner. The principle of gas compression by the compressor may be the same as that by various compressors in the heat pump systems of the air conditioners in related art. Accordingly, in the embodiment of the present application, relative structures for gas compression in the compressor may be the same as those inside the various compressors in the heat pump systems of the air conditioners in related art.

In some embodiments of the present application, the compressor further includes a second cavity, a muffling cover 400, a suction pipe, a discharge pipe 600 and a drive assembly, wherein the muffling cover 400 is disposed inside the housing 100, is hermetically connected to an inner wall of the housing 100, and divides an internal space of the housing 100 into the first cavity 101 and the second cavity. The first cavity 101 is a high-pressure chamber of the compressor, the second cavity is a low-pressure chamber of the compressor, the suction pipe is in communication with the second cavity to provide a low-pressure medium to the compression chamber 102, and the discharge pipe 600 is in communication with the first cavity 101 to discharge a high-pressure medium.

Specifically, the driving assembly is connected to the orbiting scroll to drive it to rotate relative to the fixed scroll 200. The driving assembly may include a crankshaft, a first end of which may extend into an oil tank. An end of the orbiting scroll facing away from the fixed scroll 200 may be provided with a bearing seat, inside which a journal bearing may be provided. A second end of the crankshaft may be connected to the journal bearing. A rotary drive module may be installed inside the housing 100, and has a power output end which may be connected to the crankshaft to drive it in rotation. At the same time as the crankshaft rotates, it can drive the orbiting scroll to rotate synchronously to achieve relative rotation between the orbiting scroll and the fixed scroll 200, thereby realizing the gas compression function of the compressor. The rotary driving module may be various driving assemblies capable of outputting a rotary motion, and for example, it may be a conventional motor, an electromagnetic rotary motor, or the like. Specifically, the rotary driving module may include a motor stator connected to an inner wall of the housing 100 and a rotor assembly corresponding to the motor stator. The motor stator is cooperatively connected to the rotor assembly and the latter is connected to the crankshaft. In this way, while the motor electronically drives the rotor assembly to rotate, the crankshaft may synchronously rotate with the rotor assembly.

It should be understood that when the compressor is in operation, the valve plate 320 can slide to abut against the limiting plate 330, the first through-hole 313 is opened, and the check valve 300 can be in an open state to communicate the compression chamber 102 with the first cavity 101. At this time, the compressed high-pressure gas discharged from the exhaust port of the compression chamber 102 can flow into the first cavity 101 through the check valve 300. Correspondingly, when the compressor is not in operation, i.e., when the compressor is in a shutdown state, the valve plate 320 can slide to abut against the base 311, the valve plate 320 closes the first through-hole 313, that is, the valve plate 320 blocks the first through-hole 313, and the check valve 300 can be in a closed state. At this time, the compression chamber 102 is not communicated with the first cavity 101, so as to prevent the backflow of gas from the first cavity 101 to the compression chamber 102.

In this embodiment, the check valve 300 includes the valve seat 310, and the at least two bosses 312 of the valve seat 310 encircle the sliding channel 316 therebetween. In this way, it is possible to first place the valve plate 320 in the sliding channel 316 and then install the check valve 300 in the process of installing the check valve 300 in the compressor. Due to the limiting effect of the valve seat 310 on the valve plate 320, the position of the valve plate 320 will not be offset during the installation of the check valve 300, which is beneficial for simplifying the installation process of the check valve 300. In addition, the cross-sectional area of the exhaust hole 201 is smaller than that of the first through-hole 313, which is beneficial for reducing the throttling loss in the check valve 300 of the compressed gas discharged from the exhaust hole 201 into the check valve 300.

In the related art, the high-pressure gas discharged from the compression chamber 102 usually carries oil liquid, so the surface of the valve plate 320 is usually contaminated with the oil liquid after the high-pressure gas flows through the check valve 300. Moreover, after the check valve 300 is opened, the valve plate 320 usually abuts against an inner wall of a top end of the check valve 300, and the oil liquid will easily cause the valve plate 320 to adhere to the inner wall of the top end of the check valve 300 due to its viscosity. In this way, after the compressor is shut down, when the valve plate 320 adheres to the inner wall of the top end of the check valve 300, the valve plate 320 is usually difficult to fall back, which makes it difficult for the check valve 300 to close and thus easily leas to the problem of the backflow of the gas from the first cavity 101 to the compression chamber 102.

Figure 8:
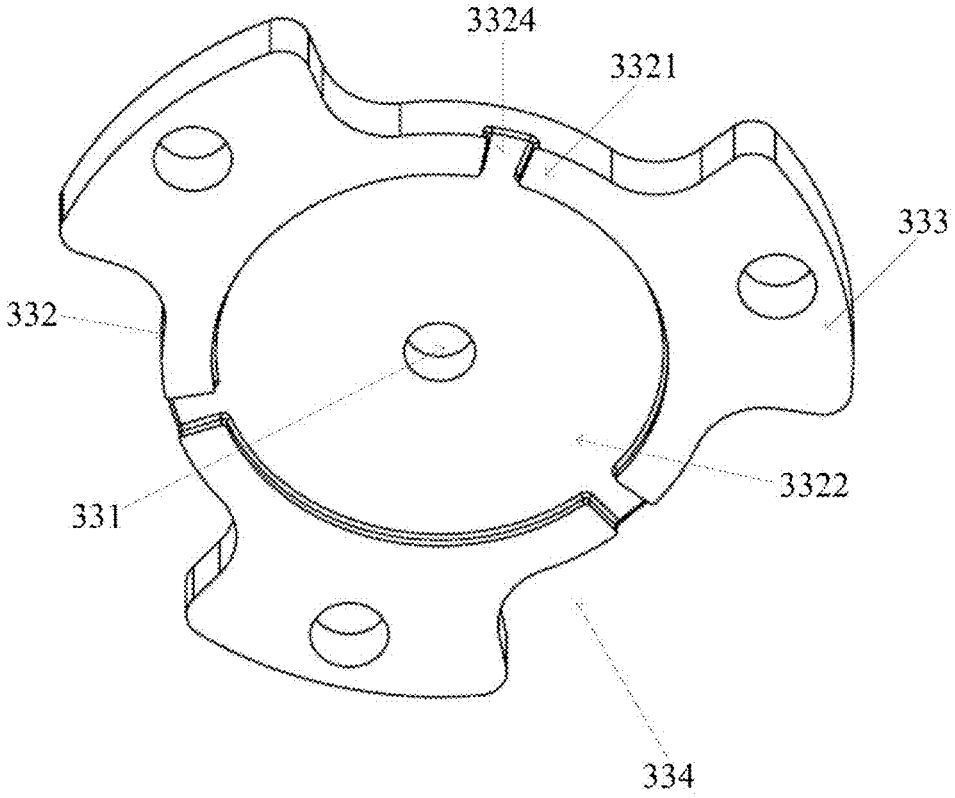
FIG. 8 is a second schematic structural diagram of a limiting plate in an embodiment of the present application.
Figure 9:
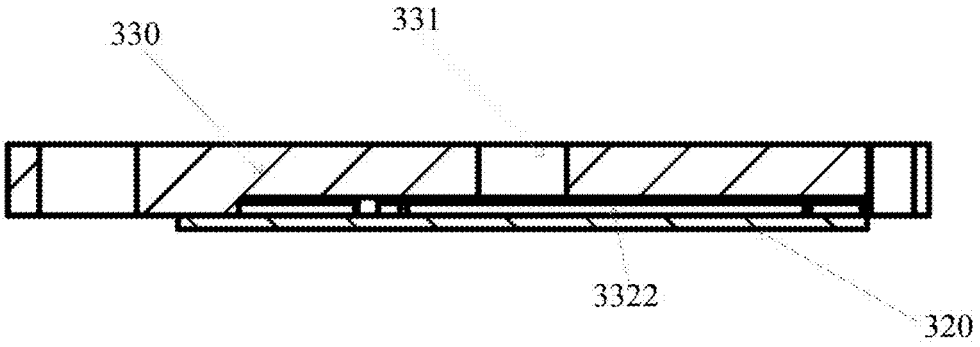
FIG. 9 is a sectional view when the limiting plate abuts against the valve plate in the embodiment shown in FIG. 8.

Optionally, referring to FIGS. 8 and 9, the limiting plate 330 is provided with a second through-hole 331 opposite the valve plate 320, and an end face of an end of the limiting plate 330 facing the valve plate 320 is provided with a protruding portion 3321, which protrudes toward the side of the valve plate 320, is disposed around the second through-hole 331, and is opposite to the valve plate 320.

When the compressor is in operation, the compressed gas discharged from the compression chamber 102 into the check valve 300 through the exhaust port can drive the valve plate 320 to slide toward the side of the limiting portion until the valve plate 320 can slide to abut against the protruding portion 3321, as shown in FIG. 9, which is a schematic diagram of a state when the valve plate 320 slides to abut against the protruding portion 3321. Correspondingly, when the compressor is in the shutdown state, since the gas pressure in the first cavity 101 is higher than that in the compression chamber 102, the high-pressure gas in the first cavity 101 moves toward the side of the compression chamber 102 and can pass through the limiting plate 330 from the second through-hole 331. The high-pressure gas passing through the limiting plate 330 from the second through-hole 331 can push the valve plate 320 to slide toward the side of the base 311 until the valve plate 320 abuts against the base 311. At this time, the valve plate 320 closes the first through-hole 313, so that the high-pressure gas in the first cavity 101 cannot enter the compression chamber 102 through the first through-hole 313, to prevent the backflow of the gas in the first cavity 101.

In this embodiment, since the protruding portion 3321 is opposite to the valve plate 320, the valve plate 320 moves to abut against the protruding portion 3321 and cannot continue to slide toward the side of the limiting plate 330 under the blocking effect of the protruding portion 3321 when the compressor is in operation. At this time, the valve plate 320 is only in contact with the protruding portion 3321, and other regions in the limiting plate 330 except for the protruding portion 3321 are oppositely spaced apart from the valve plate 320, which is beneficial for reducing the contact area between the limiting plate 330 and the valve plate 320. In this way, the viscosity between the valve plate 320 and the limiting plate 330 will also decrease accordingly, which is beneficial for the high-pressure gas in the first cavity 101 to push the valve plate 320 to separate from the limiting plate 330 to close the first through-hole 313 when the compressor is in the shutdown state.

Optionally, the limiting plate 330 includes a first limiting portion 332 having a circular plate shape, the second through-hole 331 is provided at an axis position of the first limiting portion 332, the protruding portion 3321 includes an annular protrusion that protrudes toward the side of the valve plate 320 along an edge of the first limiting portion 332, and the protruding portion 3321 and the first limiting portion 332 encircle a groove-shaped space 3322 therebetween.

The valve plate 320 has a circular plate shape and is coaxially arranged with the first limiting portion 332, and an inner diameter of the first limiting portion 332 is smaller than a diameter of the valve plate 320.

The inner diameter of the first limiting portion 332 is a diameter of a circular hole inside the first limiting portion 332, that is, a diameter of a circular region corresponding to the groove-shaped space 3322. The diameter of the valve plate 320 is a diameter of a circular end face of the valve plate 320.

In this embodiment, the second through-hole 331 is disposed at the axis position of the first limiting portion 332, and the valve plate 320 is disposed coaxially with the first limiting portion 332. In this way, when the compressor is in the shutdown state, the high-pressure gas entering the check valve 300 from the second through-hole 331 acts on a surface of the valve plate 320 when the pushing force of the valve plate 320 can be uniformly applied, which is beneficial for the high-pressure gas to smoothly push the valve plate 320 to slide toward the side of the base 311. Meanwhile, due to the fact that the inner diameter of the first limiting portion 332 is smaller than the diameter of the valve plate 320, only an edge of the valve plate 320 is in contact with the protruding portion 3321 in the limiting plate 330 when the valve plate 320 abuts against the limiting plate 330, which is beneficial for reducing a viscous force generated by an oil film between the valve plate 320 and the limiting plate 330, so as to facilitate the high-pressure gas entering the check valve 300 from the second through-hole 331 to push the valve plate 320 to separate from the limiting plate 330.

Optionally, the protruding portion 3321 is provided with a communication groove 3324, through which the groove-shaped space 3322 is in communication with the first cavity 101.

Referring to FIGS. 8 and 9, when the valve plate 320 abuts against the limiting plate 330, the valve plate 320 can cover a mouth of the communication groove 3324.

Referring to FIGS. 1-2, in the process of switching the compressor from the operating state to the shutdown state, and when the valve plate 320 abuts against the limiting plate 330, the high-pressure gas in the first cavity 101 can enter the groove-shaped space 3322 not only along the second through-hole 331, but also along the communication groove 3324, which is beneficial for increasing a flow rate of the high-pressure gas entering the groove-shaped space 3322 from the first cavity 101, thereby increasing the pushing force of the high-pressure gas on the valve plate 320 in the shutdown state of the compressor, so that the valve plate 320 can be quickly closed, and the closing speed of the check valve 300 can be thus improved. Meanwhile, the valve plate 320 covers the mouth of the communication groove 3324, which is further beneficial for the high-pressure gas entering form the communication groove 3324 to push the valve plate 320 to separate from the limiting plate 330.

Optionally, referring to FIG. 8, the protruding portion 3321 is provided with a plurality of communication grooves 3324, which are arranged at equal intervals around an axis of the first limiting portion 332.

Referring to FIG. 1, in some embodiments of the present application, when the compressor is switched from the operating state to the shutdown state and before the check valve 300 is closed, the high-pressure gas in the first cavity 101 may flow back toward the side of the compression chamber 102 along a direction indicated by arrows in FIG. 1. In this way, the backflow gas can drive the valve plate 320 to slide toward the side of the base 311 to close the check valve 300.

In this embodiment, the provision of the plurality of communication grooves 3324 is beneficial for further increasing the flow rate of the high-pressure gas entering the groove-shaped space 3322 from the first cavity 101, thereby increasing the pushing force of the high-pressure gas on the valve plate 320 in the shutdown state of the compressor, so that the valve plate 320 can be quickly closed and the closing speed of the check valve 300 can be thus improved. Meanwhile, the fact that the plurality of communication grooves 3324 are arranged at equal intervals around the axis of the first limiting portion 332 is beneficial for improving the uniformity of the force applied to the valve plate 320 in the process of closing the valve plate 320, so that the high-pressure gas can smoothly push the valve plate 320 to slide toward the side of the base 311.

Figure 6:
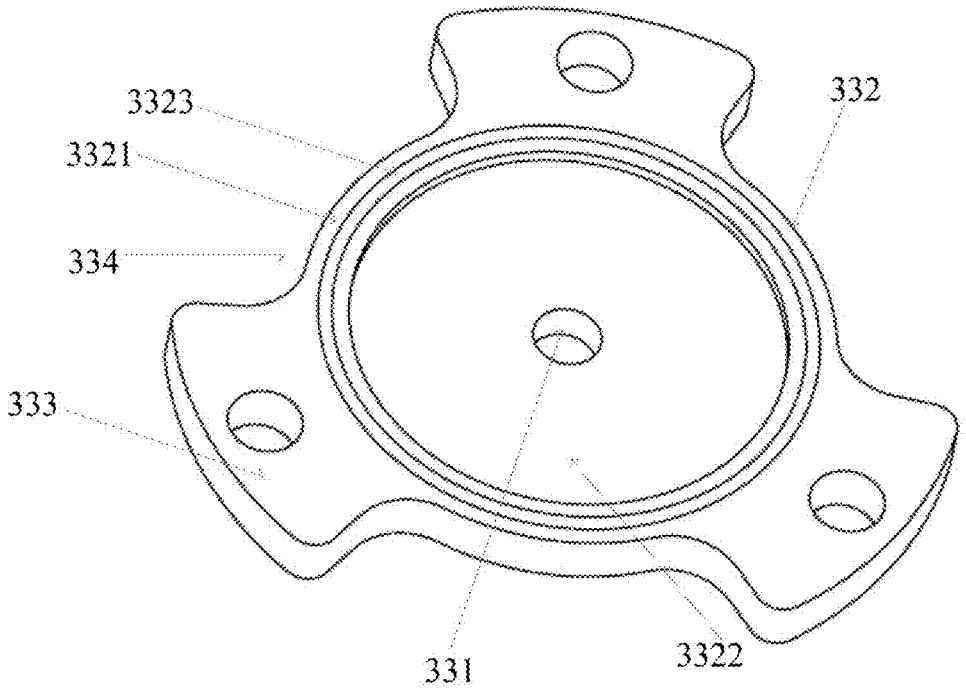
FIG. 6 is a first schematic structural diagram of a limiting plate in an embodiment of the present application.
Figure 7:
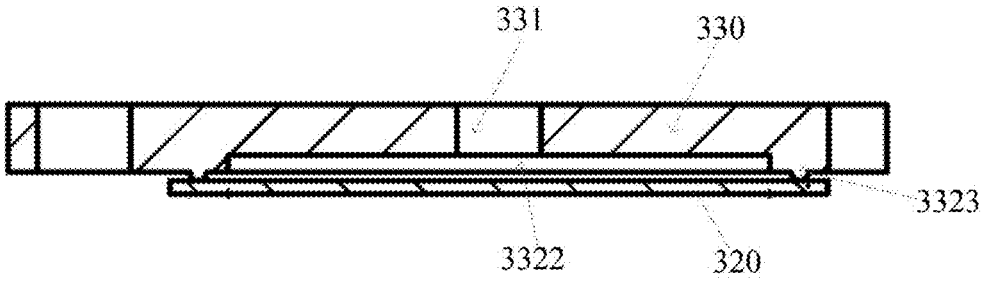
FIG. 7 is a sectional view when the limiting plate abuts against the valve plate in the embodiment shown in FIG. 6.

Optionally, referring to FIGS. 6 and 7, an end face of an end of the protruding portion 3321 facing the valve plate 320 is provided with a circular linear protrusion 3323, which is opposite to the valve plate 320, is coaxially arranged with the valve plate 320, and has a smaller diameter than the valve plate 320.

Referring to FIG. 6, the linear protrusion 3323 may be a circular strip-shaped protrusion in the end face of the end of the protruding portion 3321 facing the valve plate 320. Due to the fact that the linear protrusion 3323 is opposite to the valve plate 320, is coaxially arranged with the valve plate 320, and has a smaller diameter than the valve plate 320, when the valve plate 320 moves to abut against the linear protrusion 3323, as shown in FIG. 7, the valve plate 320 cannot further move toward the side of the protruding portion 3321 due to the blocking by the linear protrusion 3323. That is, the linear protrusion 3323 separates the protruding portion 3321 from the opposite valve plate 320. During the operation of the compressor, the limiting plate 330 only contacts the valve plate 320 through the linear protrusion 3323, which is beneficial for further reducing the contact area between the limiting plate 330 and the valve plate 320 during the operation of the compressor.

In this embodiment, the end face of the end of the protruding portion 3321 facing the valve plate 320 is provided with the circular linear protrusion 3323, which is opposite to the valve plate 320, which is coaxially arranged with the valve plate 320, and the diameter of which is smaller than that of the valve plate 320. This is beneficial for further reducing the contact area between the limiting plate 330 and the valve plate 320 during the operation of the compressor, thereby further reducing the viscous force of the oil film between the valve plate 320 and the limiting plate 330 during the operation of the compressor, and further facilitating the separation between the valve plate 320 and the limiting plate 330.

Optionally, the limiting plate 330 further includes at least two lug plates 333, which protrude outward from a side wall of the first limiting portion 332, and which are in one-to-one correspondence with the at least two bosses 312 and opposite to the corresponding bosses 312, and the limiting plate 330 is fixedly connected to the at least two bosses 312 through the at least two lug plates 333, a notch region 334 is formed between two adjacent lug plates 333, and the gas flow passage 314 is communicated with the first cavity 101 through the corresponding notch region 334.

Figure 3:
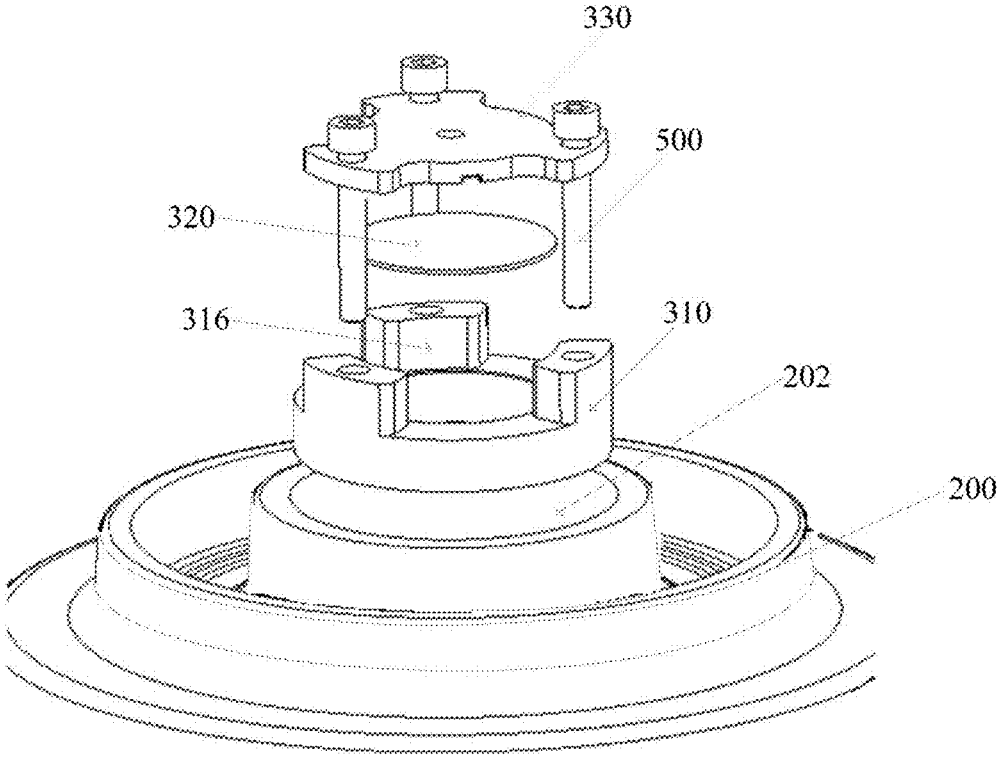
FIG. 3 is an exploded view of a structure of a connection between a check valve and a fixed scroll in an embodiment of the present application.

Referring to FIG. 3, in some embodiments of the present application, both the lug plates 333 and the bosses 312 can be provided with threaded holes, so as to connect the lug plates 333 and the bosses 312 through bolts 500.

It should be understood that, due to the fact that the at least two lug plates 333 are in one-to-one correspondence with the at least two bosses 312 and opposite to the corresponding bosses 312, the notch regions 334 in the limiting plate 330 are also in one-to-one correspondence with the gas flow passages 314 and opposite to the corresponding notch regions 334, so that the gas flow passage 314 can be communicated with the first cavity 101 through the corresponding notch region 334.

Specifically, during the operation of the compressor, the compressed gas generated in the compression chamber 102 can enter the first cavity 101 sequentially along the exhaust port, the first through-hole 313, the sliding channel 316, the gas flow passage 314 and the corresponding notch region 334. The compressed gas may also push the valve plate 320 to slide toward the side of the limiting plate 330 during its flow into the sliding channel 316.

The mouth of the communication groove 3324 located at the edge of the first limiting portion 332 can be located in the notch region 334. In this way, in the process of switching the compressor from the operating state to the shutdown state, the high-pressure gas in the first cavity 101 can also flow into the communication groove 3324 along the notch region 334 to enter the groove-shaped region.

In this embodiment, the limiting plate 330 includes the at least two lug plates 333 protruding outward from the side wall of the first limiting portion 332, which is beneficial for facilitating the fixed connection between the limiting plate 330 and the bosses 312. At the same time, the notch region 334 for communicating the gas flow passage 314 with the first cavity 101 can be formed to facilitate the communication between the gas flow passage 314 and the first cavity 101.

In the related art, the check valve 300 is required to be arranged in the fixed scroll 200, so there will be a certain throttling loss after the compressed gas discharged from the compression chamber 102 flows through the check valve 300.

Optionally, a sum of cross-sectional areas of all gas flow passages 314 included in the valve seat 310 is greater than a cross-sectional area of the exhaust hole 201.

Side surfaces of the at least two bosses 312 facing the first through-hole 313 can be located in a same cylindrical face. The cross-sectional area of the gas flow passage 314 may refer to an area of a cross section where the gas flow passage 314 intersects the cylindrical face. Correspondingly, the sum of the cross-sectional areas of all the gas flow passages 314 included in the valve seat 310 refers to a sum of the cross-sectional areas of all the gas flow passages 314. For example, referring to FIG. 2, in some embodiments of the present application, the number of the bosses 312 is three, and correspondingly, the number of the gas flow passages 314 is also three, and in this case, the sum of the cross-sectional areas of the three gas flow passages 314 is greater than the cross-sectional area of the exhaust hole 201.

In this embodiment, the sum of the cross-sectional areas of the gas flow passages 314 is greater than the cross-sectional area of the exhaust hole 201, and meanwhile, the cross-sectional area of the exhaust hole 201 is smaller than that of the first through-hole 313. As a result, it is possible to make the cross-sectional area of each flow region of gas flow in the check valve 300 greater than that of the exhaust hole 201. Thus, it is possible for the compressed gas discharged from the exhaust hole 201 to smoothly pass through the check valve 300, reducing the throttling effect of the check valve 300 on the compressed gas, and thus reducing the throttling loss of the compressed gas discharged from the compression chamber 102 after flowing through the check valve 300.

Optionally, the bosses 312 are disposed to be spaced apart from the first through-hole 313, and side surfaces of the at least two bosses 312 facing the first through-hole 313 are located in a same cylindrical face. An end face of an end of the base 311 facing the valve plate 320 includes a second limiting portion 315 which includes an annular region between the cylindrical face and the first through-hole 313, and a diameter of the valve plate 320 is greater than an aperture size of the first through-hole 313.

In this embodiment, the end face of the end of the base 311 facing the valve plate 320 includes the second limiting portion 315. In this way, when the valve plate 320 moves to abut against the base 311, the valve plate 320 cannot enter the first through-hole 313 due to the blocking by the second limiting portion 315, thereby limiting the sliding range of the valve plate 320.

Optionally, the compressor further includes a muffling cover 400 located on the side of the fixed scroll 200 facing away from the orbiting scroll, and the check valve 300 is fixedly connected to the muffling cover 400 or to the fixed scroll 200.

Figure 4:
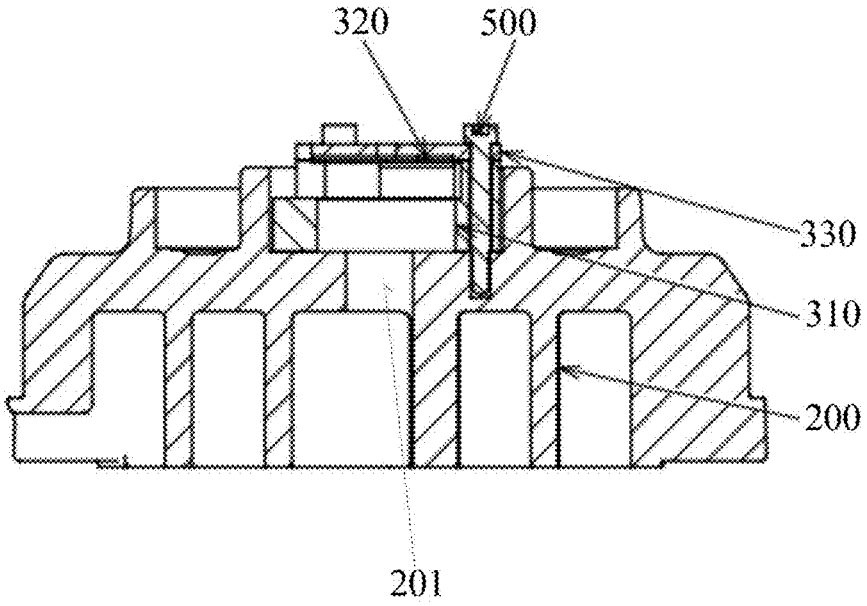
FIG. 4 is a schematic diagram of a connection between a check valve and a fixed scroll in an embodiment of the present application.

Referring to FIGS. 3 and 4, in some embodiments of the present application, an end face of an end of the fixed scroll 200 facing away from the orbiting scroll is provided with a mounting groove 202, and the check valve 300 may be embedded in the mounting groove 202 and fixedly connected to the fixed scroll 200 through a bolt 500, wherein the bolt 500 may sequentially connect the limiting portion, the boss 312 and the fixed scroll 200, so as to realize the fixed connection between the check valve 300 and the fixed scroll 200.

Figure 5:
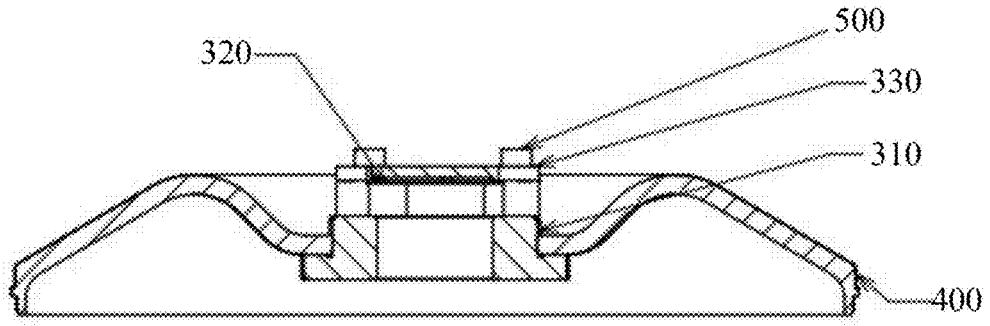
FIG. 5 is a schematic diagram of a connection between a check valve and a muffling cover in an embodiment of the present application.

In some other embodiments of the present application, the muffling cover 400 is located on the side of the fixed scroll 200 facing away from the orbiting scroll. Referring to FIG. 5, the muffling cover 400 is provided with a connecting hole, the valve seat 310 is inserted in the connecting hole and is connected with the connecting hole by interference fit to realize the fixed connection between the check valve 300 and the muffling cover 400.

In this embodiment, the check valve 300 may be mounted on the muffling cover 400 or on the fixed scroll 200 as required, which is beneficial to applying the check valve 300 to various types of compressors.

The embodiments of the present application have been described above in conjunction with the drawings, but the present application is not limited to the above specific embodiments, and these specific embodiments are merely illustrative rather than limiting. Under the teaching of the present application, those having ordinary skills in the art can make many forms without departing from the purpose and scope of protection of the present application, all of which fall within the protection of the present application.

What is claimed is:

1. A compressor, characterized by comprising a housing (100), a fixed scroll (200), an orbiting scroll and a check valve (300), the fixed scroll (200) and the orbiting scroll are respectively disposed in the housing (100), cooperatively connected to each other and encircle a compression chamber (102) therebetween, the housing (100) comprises a first cavity (101) which is located on a side of the fixed scroll (200) facing away from the orbiting scroll, and the fixed scroll (200) is provided with an exhaust hole (201) for the compression chamber (102);

the check valve (300) comprises a valve seat (310), a valve plate (320) and a limiting plate (330), wherein the valve seat (310) is arranged on a side of the fixed scroll (200) facing away from the orbiting scroll, and comprises a base (311) and at least two bosses (312) protruding from an end face of an end of the base (311) facing away from the fixed scroll (200), wherein the base (311) is provided with a first through-hole (313) which is opposite to the exhaust hole (201), the at least two bosses (312) are arranged at intervals around the first through-hole (313), and gas flow passages (314) are formed between adjacent bosses (312) and in communication with the first cavity (101), wherein the limiting plate (330) is located on a side of the bosses (312) facing away from the base (311) and is fixedly connected to an end of each of the bosses (312) which is away from the base (311), and the exhaust hole (201) has a smaller cross-sectional area than the first through-hole (313);

the at least two bosses (312) encircle a sliding channel (316) therebetween, the valve plate (320) is slidably connected to the sliding channel (316) and along which the valve plate (320) is slidable between the limiting plate (330) and the base (311), wherein the first through-hole (313) is opened and the first cavity (101) is communicated with the compression chamber (102) when the valve plate (320) slides to abut against the limiting plate (330);

the valve plate (320) closes the first through-hole (313) and the first cavity (101) is not communicated with the compression chamber (102) when the valve plate (320) slides to abut against the base (311).

2. The compressor according to claim 1, characterized in that the limiting plate (330) is provided with a second through-hole (331) which is opposite to the valve plate (320), and an end face of an end of the limiting plate (330) facing the valve plate (320) is provided with a protruding portion (3321), which protrudes toward the side of the valve plate (320), is arranged around the second through-hole (331), and is opposite to the valve plate (320).

3. The compressor according to claim 2, characterized in that the limiting plate (330) comprises a first limiting portion (332) having a circular plate shape, the second through-hole (331) is provided at an axis position of the first limiting portion (332), the protruding portion (3321) comprises an annular protrusion which protrudes toward the side of the valve plate (320) along an edge of the first limiting portion (332), and the protruding portion (3321) and the first limiting portion (332) encircle a groove-shaped space (3322) therebetween;

the valve plate (320) has a circular plate shape and is coaxially arranged with the first limiting portion (332), and an inner diameter of the first limiting portion (332) is smaller than a diameter of the valve plate (320).

4. The compressor according to claim 3, characterized in that the protruding portion (3321) is provided with a communication groove (3324), through which the groove-shaped space (3322) is communicated with the first cavity (101).

5. The compressor according to claim 4, characterized in that the protruding portion (3321) is provided with a plurality of communication grooves (3324), which are arranged at equal intervals around an axis of the first limiting portion (332).

6. The compressor according to claim 3, characterized in that an end face of an end of the protruding portion (3321) facing the valve plate (320) is provided with a circular linear protrusion (3323), which is opposite to the valve plate (320), is coaxially arranged with the valve plate (320), and a diameter of which is smaller than that of the valve plate (320).

7. The compressor according to claim 3, characterized in that the limiting plate (330) further comprises at least two lug plates (333), which protrude outward from a side wall of the first limiting portion (332), and are in one-to-one correspondence with the at least two bosses (312) and opposite to the corresponding bosses (312), wherein the limiting plate (330) is fixedly connected to the at least two bosses (312) through the at least two lug plates (333), notch regions (334) are formed between the at least two adjacent lug plates (333), and the gas flow passages (314) are communicates with the first cavity (101) through the corresponding notch regions (334).

8. The compressor according to claim 1, characterized in that a sum of cross-sectional areas of all gas flow passages (314) comprised in the valve seat (310) is greater than a cross-sectional area of the exhaust hole (201).

9. The compressor according to claim 1, characterized in that the bosses (312) are arranged to be spaced apart from the first through-hole (313), side surfaces of the at least two bosses (312) which face the first through-hole (313) are located in a same cylindrical face, and an end face of an end of the base (311) facing the valve plate (320) comprises a second limiting portion (315) which comprises an annular region between the cylindrical face and the first through-hole (313), wherein a diameter of the valve plate (320) is greater than an aperture size of the first through-hole (313).

10. The compressor according to claim 1, characterized in that the compressor further comprises a muffling cover (400) which is located on the side of the fixed scroll (200) facing away from the orbiting scroll, and the check valve (300) is fixedly connected to the muffling cover (400) or to the fixed scroll (200).

* * * * *